United States Patent [19]

Laguionie

[11] Patent Number: 4,596,517

[45] Date of Patent: Jun. 24, 1986

[54] PRESSURIZED FLUID SUPPLY CIRCUIT COMPRISING A VARIABLE DISPLACEMENT PUMP

[75] Inventor: Pierre Laguionie, Crepy-en-Valois, France

[73] Assignee: Poclain, Le Plessis Belleville, France

[21] Appl. No.: 696,331

[22] Filed: Jan. 29, 1985

[51] Int. Cl.[4] ..... F04B 49/00

[52] U.S. Cl. ..... 417/216; 417/218; 60/452

[58] Field of Search ..... 417/212, 213, 216, 217, 417/218, 222; 60/452

[56] References Cited

U.S. PATENT DOCUMENTS

| | | | |
|---|---|---|---|
| 3,785,754 | 1/1974 | Miller | 417/213 |
| 3,788,773 | 1/1974 | Van der Kolk | 417/217 X |
| 3,788,774 | 1/1974 | Roesslein | 417/218 |
| 3,952,509 | 4/1976 | Coleman | 60/445 X |
| 4,065,228 | 12/1977 | McMillan | 417/216 X |
| 4,350,078 | 9/1982 | Olofsson | 91/461 X |

FOREIGN PATENT DOCUMENTS

| | | | |
|---|---|---|---|
| 2407402 | 5/1979 | France . | |
| 2476245 | 8/1981 | France . | |
| 66003 | 6/1978 | Japan | 417/218 |
| 19919 | 2/1980 | Japan | 417/216 |
| 87865 | 7/1980 | Japan | 417/218 |
| 156483 | 12/1981 | Japan | 417/212 |
| 2087521 | 5/1982 | United Kingdom . | |

OTHER PUBLICATIONS

Proceedings of the National Conference on Fluid Power, Oct. 21, 22, 23, 1975, vol. XXIX, Thirty First Annual Meeting, sponsored by Illinois Institute of Technology, Chicago, IL 60616.

*Primary Examiner*—William L. Freeh
*Assistant Examiner*—Paul F. Neils
*Attorney, Agent, or Firm*—Mason, Fenwick & Lawrence

[57] ABSTRACT

The invention relates to a supply circuit supplying two pressure-using members in parallel, by means of a power-regulated variable displacement pump. Manipulators, associated to the distributors controlling said pressure-using members are fed with a fluid whose pressure can vary as a function of the speed driving the pump and are of a potentiometric type. The invention finds an application in the supply circuit of a hydraulic shovel.

1 Claim, 3 Drawing Figures

PRESSURIZED FLUID SUPPLY CIRCUIT COMPRISING A VARIABLE DISPLACEMENT PUMP

Known supply circuits supplying pressurized fluids to at least one consuming part are constituted by:

said at least one consuming part, at least one variable displacement pump, means of adjusting the volume of said variable displacement pump, as many main distributors of pressurized fluid as there are consuming parts, each main distributor being controlled, operationally coupled with one of the consuming parts and interposed between said consuming part and the delivery pipe with which said variable displacement pump is equipped, a source of control fluid to control every main distributor, and, as many hydraulic manipulators as there are main distributors, every manipulator being operationally coupled with one of the main distributors and being interposed between said main distributor and the source of control fluid, said latter comprising a pump equipped with a delivery pipe on which is mounted a calibrated discharge valve.

In a circuit of this type, on the one hand, the motor driving the pump, which is generally a "Diesel" type motor, has a tendency to turn at full speed, even when the consuming part or parts are not supplied with pressurized fluid, on the other hand, the regulating of the flow of the main pump, merely by adjusting the value of the pump volume, has the effect of supplying first and foremost the consuming part requiring the lowest pressure and in doing so creating unbalance between the supplies to the different consuming parts.

These disadvantages should be eliminated and in particular the unbalance, by limiting simultaneously the powers absorbed by the different consuming parts, so as to preserve a certain proportionality between the speeds of the movements actually generated by or in the said consuming parts, and the speeds required by the control device.

This is precisely the object of the present invention, which proposes an arrangement in which the pump of the source of control fluid is part of a tachometric device which delivers a control pressure whose value is a function of the speed driving the variable displacement pump, the hydraulic manipulators of the main distributors being of a potentiometric type.

The following advantageous dispositions are also preferably adopted:

the circuit comprises at least two fluid receiving means;

the pump of the source of control fluid is of the tachometric type and is coupled to the same driving shaft as the variable displacement pump; whereas the source of control fluid further comprises a restriction situated on the delivery circuit of the tachometric pump between the latter and the calibrated discharge valve, and, a pressure modulation distributor, with two positions, connected via a supply pipe, to the part of the delivery pipe of the tachometric pump which is situated between the restriction and the calibrated discharge valve, via a control pipe connected to each manipulator, and via a discharge pipe to a pressure-free exhaust, the different manipulators being connected in parallel to the said control pipe; and that on the one hand, the pressure modulation distributor is coupled to two fluid jacks of mutually antagonistic effects, connected to those parts of the delivery pipe of the tachometric pump which are situated, for one of said jacks, between said pump and the restriction, and for the other jack, between the restriction and the calibrated discharge valve, on the other hand, the two positions of the pressure modulation distributors correspond, the first position to creating a communication between the supply and control pipes, the second position to creating a communication between the control and discharge pipes, the active portions of the two jacks and the restriction having selected values, such that the pressure modulation distributor is placed in its first position when the driving speed of the tachometric pump is equal to the preset nominal speed, and, in its second position, when the driving speed of the tachometric pump is below the nominal speed.

The invention will be more readily understood on reading the following description with reference to the accompanying drawings in which.

The illustrated circuit comprises.

Figure 1:
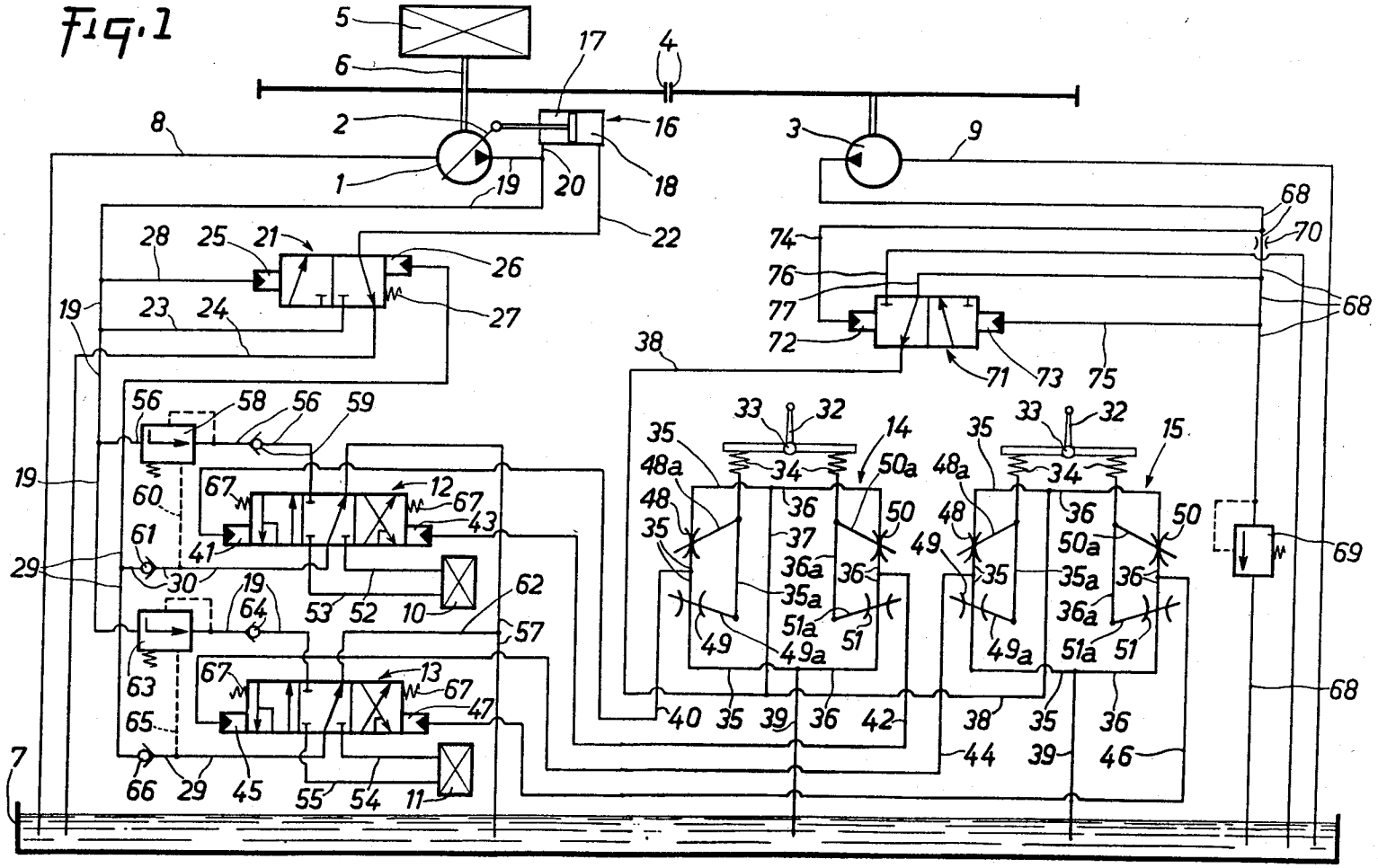
FIG. 1 shows a diagram of a supply circuit according to the invention.

a main pump 1, of variable displacement type, provided with a lever 2 for adjusting its capacity, a tachometric pump 3, two gear wheels 4, intermeshing, and fast in rotation, one with the pump 1, and the other with the pump 3, a "Diesel" motor 5 driving the two pumps, and the driving shaft 6 of which is fast in rotation with the shaft of pump 1, a fluid tank 7, to which are connected respectively, induction pipes 8 and 9 of pumps 1 and 3, two pressure using circuits 10 and 11, or fluid receiving members 10, 11, two main distributors of pressurized fluid 12, 13, each having three positions and corresponding to receiving members 10, 11 respectively, two hydraulic manipulators 14, 15 which respectively correspond to the main distributors 12, 13, a pump capacity control jack 16, which is constituted by a jack with two chambers 17, 18, coupled to the lever 2 for adjusting the capacity of pump 1, the chamber 17 being connected to the delivery pipe 19 of pump 1, via a pipe 20, the chamber 18 being connected to a two-position fluid distributor 21 via a conduit 22.

A conduit 23 connects the distributor 21 to the delivery pipe 19, a pipe 24 connecting said distributor to the tank 7. Said distributor 21 is coupled to two jacks 25, 26 for adjusting its position, and being of antagonistic effects, and to a spring 27 returning the distributor to its second position, and having the same effect as jack 28. Jack 25 is connected via a pipe 28 to a pipe 19 and jack 26 is connected via a pipe 29 to the main distributor 13, and via pipe 30, connected to pipe 29, to the main distributor 12.

The two positions of fluid distributor 21 correspond:

the first position, to the preponderance of the effect of jack 25 to creating a communication between pipes 22 and 23, and to closing off pipe 24; and the second position, to the preponderance of the effect of jack 26, to creating a communication between pipes 22 and 24, and to closing off pipe 23.

It should also be noted that control jack 16 operationally coupled to distributor 21 has the effect of changing the position of lever 2 adjusting the pump volume as a function of the variation of the pressure contained in pipe 20, hence also in delivery pipe 19.

Every manipulator 14, 15 is constituted diagrammatically by two sets of restrictions, each one comprising two restrictions of adjustable value 48, 49 respectively 50, 51, situated on a pipe 35, respectively 36. Adjusting members 48*a*, 49*a* on the one hand, and 50*a*, 51*a* on the other hand, for these restrictions are coupled to a control lever 35*a*, 36*a*, respectively. The conduits 35, 36 of a manipulator are connected, together at their two respective ends, as well as, on the one hand, with a control fluid supply pipe, between restrictions 48 and 50, (pipe 38 of the manipulator 15, pipe 37 connected to pipe 38, for manipulator 14), on the other hand, to a pipe 39, between restrictions 49, 51, and pipe 39 connected to tank 7. A pipe 40 connects the part of pipe 35 of the manipulator 14 which is situated between restrictions 48 and 49, to a control jack 41 controlling the main distributor 12; a pipe 42 connects that part of the pipe 36 of the manipulator 14 which is situated between restrictions 50 and 51 to another control jack 43 coupled to the same main distributor 12, of antagonistic effect, of jack 41; a pipe 44 connects the part of pipe 35 of manipulator 15 which is situated between restrictions 48 and 49 to a control jack 45 controlling the main distributor 13; and, a pipe 46 connects that part of the pipe 36 of the manipulator 15 which is situated between restrictions 50 and 51 to another control jack 47 coupled to the same main distributor 13, of antagonistic effect, of jack 45.

Figure 2:
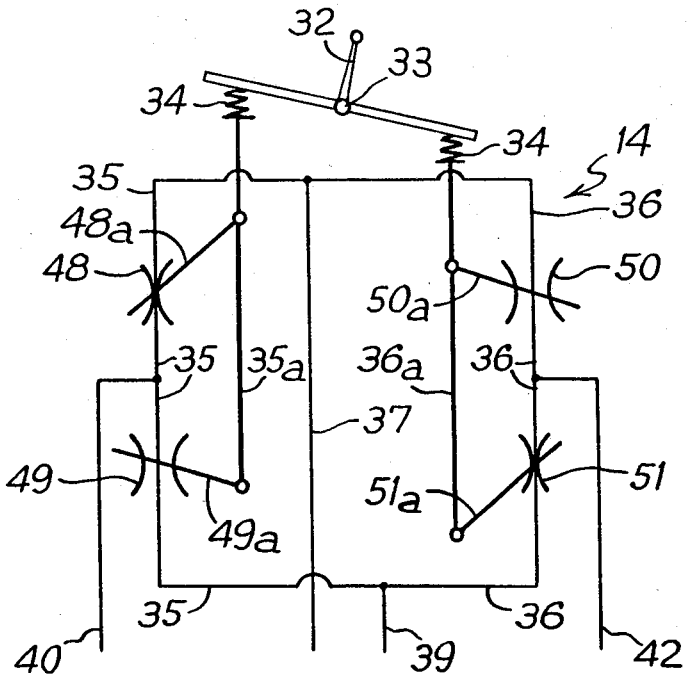
FIGS. 2 and 3 show two other positions of one of the manipulators shown in FIG. 1.
Figure 3:
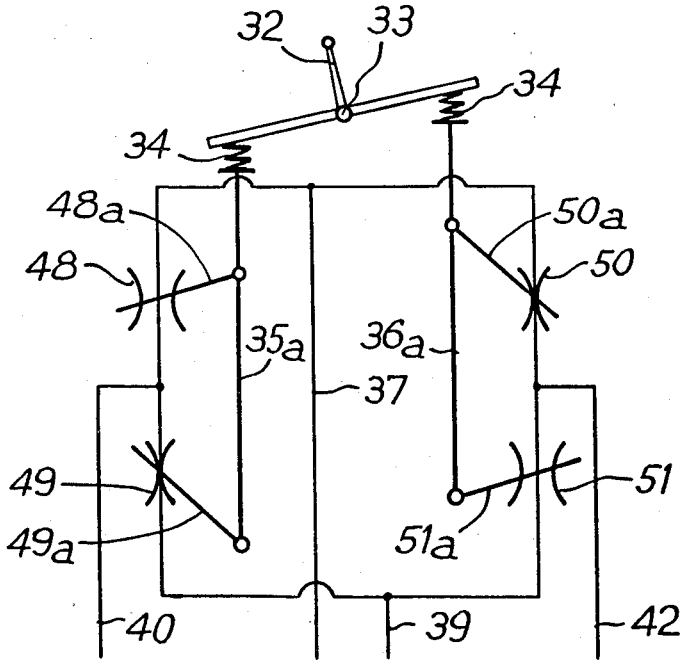

Each manipulator comprises a single control lever 32 controlling levers 35*a*, 36*a*, pivotable about an axis 33, with springs 34 interposed between lever 32 and lever 35*a*, and between lever 32 and lever 36*a*. Restrictions 48, 49, 50, 51 are progressive and have the following remarkable positions:

those of FIG. 1, in which the levers 32 are in neutral position, restrictions 48 and 50 being completely closed off, and restrictions 49 and 51 being on the contrary completely open, those of FIG. 2, in which the lever 32 of the manipulator 14 has been pivoted toward lever 36*a*, restrictions 48 and 51 being closed off, and restrictions 49 and 50 being completely open; and those of FIG. 3, in which lever 32 of the manipulator 14 has been pivoted towards lever 35*a*, restrictions 48 and 51 being completely open, and restrictions 49 and 50 being completely closed.

Because of these various dispositions, the manipulators 14 and 15 are of a potentiometric type.

Each pressure-using circuit 10, 11 is connected via two pipes 52 and 53 respectively 54, 55, with the operationally-coupled main distributor 12, 13.

The main distributor 12 is also connected, via a pipe 56, to pipe 19 and by a pipe 57 to tank 7. A pressure regulating valve 58 and a non-return valve 59 are provided on pipe 56, the non-return valve 59 allowing the fluid to flow towards the main distributor 12. Valve 58 is also controlled (pipe 60) by the pressure of the fluid contained in pipe 30, between the connections of pipes 60 and 29, and allows the flow of fluid from the main distributor 12 towards pipe 29.

The main distributor 13 is connected via a pipe 62 to pipe 57. A pressure regulating valve 63 and a non-return valve 64 are mounted on that part of pipe 19 which is situated between the connection of pipe 56 and the main distributor 13, non-return valve 64 allowing the fluid to flow towards the main distributor 13. Pressure-regulating valve 63 is controlled (pipe 65) by the pressure of the fluid contained in that part of the pipe 29 situated between the main distributor 13 and the pipe connection 30. A non-return valve 66 is mounted on that part of pipe 29 situated between the connections of pipes 65 and 30, and allows the flow of fluid from the main distributor 13.

Every main distributor 12, 13 is also coupled to returning springs 67 returning it to its second position as defined hereinafter.

The three positions of main distributor 12 correspond:

the first position to creating a communication between conduits 56, 53 and 30 and pipes 52 and 57;

the second position, to creating a communication between pipes 30 and 57, and to closing off pipes 52, 53, 56; and the third position, to creating a communication between pipes 56, 52 and 30, and pipes 53 and 57.

The three positions of the main distributor 13 correspond:

the first position to creating a communication between pipes 19, 55 and 29, and pipes 54 and 62;

the second position, to creating a communication between pipes 29 and 62, and to closing off pipes 19, 54 and 55; and, the third position, to creating a communication between pipes 19, 29 and 54, and pipes 55 and 62.

The delivery pipe 68 of the tachometric pump 3 is connected to tank 7, a calibrated discharge valve 69 being mounted on said pipe 68, as well as a restriction 70 situated between the pump 3 and the discharge valve 69. A two-position distributor 71, of the sequential type, is coupled to two jacks of antagonistic effect 72 and 73, which jacks are connected, jack 72 via a pipe 74 to that part of pipe 68 which is situated between pump 3 and restriction 70, and jack 73, via a pipe 75, to that part of the pipe 68 which is situated between restriction 70 and discharge valve 69. Moreover, pipe 38 is connected to distributor 71, and pipes 76, 77 connect said distributor, pipe 76 to tank 7, and pipe 77 to that part of pipe 68 which is situated between restriction 70 and discharge valve 69.

The two positions of distributor 71 correspond:

the first position, to creating a communication between pipes 77 and 38, and closing off pipe 76; and the second position to creating a communication between pipes 38 and 76 and to closing off pipe 77.

The circuit assembly described hereinabove works as follows.

The power required for driving the main pump 1 is limited to a predetermined value by the action of control jack 16. Thus, if the pressure supplying the pressure-using circuits 10, 11 increases, the maximum supply rate decreases.

But, in addition, the pressures of the control fluids of the main distributors 12, 13, which fluids are contained in pipes 40, 42, 44, 46, are themselves controlled to values which are a function of the speed driving the tachometric pump 3. Indeed, said pressures are, as a first approximation, proportional to the value of the pressure inside pipe 38. Yet this value of the pressure inside pipe 38 is modulated as a function of the speed driving the pump 3, and therefore as a function of the speed of rotation of the driving shaft 6 of the "Diesel" type engine 5. Two different cases of operation can be observed.

In the first case, the speed driving the pump 3 is also equal to the preset nominal speed. The values of the serviceable cross-sections of the jacks 72 and 73, and of restriction 70 have been selected so that, when pump 3 turns at its nominal speed, distributor 71 is placed in its first position. The pressure in pipe 38 is then equal to that in pipe 77, and has reached its nominal value. This is quite normal since the "Diesel" type engine 5 which turns at its nominal speed, shows that the driving of pump 1 does not require a driving power greater than the maximum power which engine 5 can supply.

In the second case, on the contrary, the power of the "Diesel" type engine tends to be below the power driving the pump 1, the result being a reduction of the speed of rotation of pump 3. The pressure reduces in pipe 74, this resulting in the momentary preponderance of the effect of jack 73 and in placing distributor 71 in its second position. Pipe 38 being now in communication with pipe 76, the pressure of the fluid contained therein reduces, in the same way as the pressures of the fluids contained in pipes 40, 42, 44 and 46, and as a result, the pressures in jacks 41, 43, 45 and 47. The final effect of all this being a reduction in similar proportions of the pressurized fluid supplies to pressure-using circuits 10 and 11, and an increase in pressure loss between pipes 56 and 53 or 52, hence of the pressure in pipe 19. Distributor 21 is then subjected to the preponderant effect of jack 25 which creates a communication between pipe 22 and pipe 23, involving a reduction in the volume of the pump, hence of the resisting torque.

In the assemblies which only comprise the control jack 16, without any tachometric regulation (pump 3), the main distributors 12, 13 are controlled by fluids of which the pressures are function of a constant (and maximum) admission pressure of manipulators 14 and 15, so that, being so situated as to supply the pressure-using circuits via pipes 52 or 53, and, 54 or 55, they create a non-reduced communication between pipes 56 and 19, hence with pipe 19, whose fluid is directed naturally towards that of the pressure-using circuits 10, 11 which require the lowest pressure. Contrary to the known and disadvantageous prior operation, the new disposition enables to reduce the communications between pipes 52 or 53, and 54 or 55 with pipe 19 and consequently to supply with a certain flow even that one of pressure-using circuits 10 or 11, which requires the highest pressure.

In the circuits comprising only one fluid-receiving member, it is also possible to prevent the motor from racing when said receiving member is not supplied with pressurized fluid.

The invention is in no way limited to the description given hereinabove and on the contrary covers any modifications that can be brought thereto without departing from its scope or its spirit.

What I claim is:

1. A pressurized fluid supply circuit of the type supplying at least one consuming part, comprising:

(a) at least one consuming part;

(b) at least one variable displacement pump, each said variable displacement pump being equipped with a delivery pipe and being coupled to a driving shaft;

(c) means for adjusting the volume of said variable displacement pump;

(d) as many main distributors of pressurized fluid as there are said at least one consuming part, each of said main distributors being operationally coupled with a corresponding said consuming part and interposed between said consuming part and said delivery pipe with which said variable displacement pump is equipped;

(e) as many hydraulic manipulators as there are said main distributors, said hydraulic manipulators being manually actuated and of a potentiometric type, each said manipulator being operationally coupled with one of said main distributors and being interposed between said one of said main distributors and said source of control fluid; and (f) tachometric device means for delivering a control pressure whose valve is a function of the speed driving said at least one variable displacement pump, said tachometric device means including a source of control fluid to control each said main distributor comprising a tachometric pump having a delivery circuit, said tachometric pump being coupled to said same driving shaft as said at least one variable displacement pump and being equipped with a delivery pipe on which is mounted a calibrated discharge valve, at least two pressure-using circuits corresponding to said main distributors, a restriction situated on said delivery circuit of said tachometric pump between said tachometric pump and said calibrated discharge valve, and a pressure modulation distributor having first and second positions connected via a supply pipe to the part of said delivery pipe of said tachometric pump which is situated between said restriction and said calibrated discharge valve via said control pipe connected to each said manipulator and via a discharge pipe to a pressure-free exhaust, each said manipulator being connected in parallel to said control pipe, said pressure modulation distributor being coupled to two fluid jacks of mutually antagonistic effect, connected to those parts of said delivery pipe of said tachometric pump which are situated, for one of said jacks, between said pump and said restriction, and for the other of said jacks, between said restriction and said calibrated discharge valve, said first position of said pressure modulation distributor corresponding to creating a communication between said supply and control pipes, and said second position of said pressure modulating distributor corresponding to creating a communication between said control and discharge pipes, the active portions of said two jacks and said restriction having selected values, such that said pressure modulation distributor is placed in said first position when the driving speed of said tachometric pump is equal to a preset nominal speed, and in said second position, when the driving speed of said tachometric pump is below the nominal speed.

* * * * *